US011080988B2

(12) United States Patent
Lim et al.

(10) Patent No.: US 11,080,988 B2
(45) Date of Patent: Aug. 3, 2021

(54) INTERNET FACILITATED FIRE SAFETY SYSTEM AND REAL TIME MONITORING SYSTEM

(71) Applicant: LINGJACK ENGINEERING WORKS PTE LTD, Singapore (SG)

(72) Inventors: Kok Kheng Lim, Singapore (SG); Chen Kiang Liew, Singapore (SG)

(73) Assignee: LINGJACK ENGINEERING WORKS PTE LTD, Singapore (SG)

( * ) Notice: Subject to any disclaimer, the term of this patent is extended or adjusted under 35 U.S.C. 154(b) by 0 days.

(21) Appl. No.: 16/685,088

(22) Filed: Nov. 15, 2019

(65) Prior Publication Data

US 2020/0226916 A1 Jul. 16, 2020

(30) Foreign Application Priority Data

Jan. 10, 2019 (SG) ..... 10201900219R

(51) Int. Cl.
*G08B 27/00* (2006.01)
*A62C 37/50* (2006.01)
(Continued)

(52) U.S. Cl.
CPC ..... *G08B 27/005* (2013.01); *G08B 17/06* (2013.01); *G08B 25/08* (2013.01); *G08B 29/043* (2013.01); *A62C 37/50* (2013.01)

(58) Field of Classification Search
CPC . H04L 67/12; H04L 12/2803; G05B 19/0425; H04W 4/38; H04W 24/02;
(Continued)

(56) References Cited

U.S. PATENT DOCUMENTS 6,961,445 B1 * 11/2005 Jensen ..... G08B 13/194 348/208.15
8,842,016 B1 * 9/2014 Cazanas ..... A62C 37/50 340/611

(Continued)

FOREIGN PATENT DOCUMENTS

CN 107948079 A * 4/2018

OTHER PUBLICATIONS

"Developing a Fire Monitoring and Control System Based on IoT" by Li et al., dated 2016 (Year: 2016).*

(Continued)

*Primary Examiner* — Daniel Lai
(74) *Attorney, Agent, or Firm* — WPAT, PC

(57) ABSTRACT

An Internet facilitated fire safety system and real time monitoring system is disclosed. The fire safety system comprises a plurality of smart fire safety devices and equipment, including fire extinguishers, hose reels, fire doors, exit lights, emergency lights, sprinkler tank and sprinkler system, system to monitor $CO_2$ and/or carbon monoxide levels, and the like. Each of these safety devices and equipment is connected by an IOT interface device and a wireless gateway to computer servers an electronic communications network. The IOT interface devices have a plurality of sensors to detect the operational condition of each safety device and equipment. Data obtained from the sensors is analyzed and interpreted using software and algorithms by servers in the system. Since each fire safety device and equipment is electronically connected, transmitting data and information on its operational status occurs in real time and 24/7.

30 Claims, 9 Drawing Sheets

(51) Int. Cl.
*G08B 17/06* (2006.01)
*G08B 29/04* (2006.01)
*G08B 25/08* (2006.01)

(58) Field of Classification Search
CPC ..... H04W 4/90; H04W 4/80; H04W 84/18; H04W 48/10; H04W 56/0015; H04W 4/021; H04W 4/023; G08B 25/016; G08B 21/02; G08B 21/0484; G08B 21/0492; G08B 17/06; G08B 21/18; G08B 25/006; G08B 25/08; G08B 27/005; G08B 29/043; G08B 29/145; G08B 17/117; G08B 17/10; G08B 21/14; G08B 21/16; G08B 17/00; G08B 17/04; G08B 17/125; G08B 25/10; G08B 13/196; G08B 17/103; G08B 17/11; G08B 17/12; A62C 37/08; A62C 35/68; A62C 3/16; A62C 35/023; A62C 31/02; A62C 35/605; A62C 37/36; A62C 13/62; A62C 13/76; A62C 35/64; A62C 37/04; A62C 37/40; A62C 37/48; A62C 37/50; A62C 3/00; A62C 13/64; A62C 2/06; A62C 35/15; A62C 37/38; A62C 37/42; A62C 37/44
See application file for complete search history.

(56) References Cited

U.S. PATENT DOCUMENTS

| | | | | |
|---|---|---|---|---|
| 10,441,832 | B1 * | 10/2019 | Trivelpiece | G08B 25/007 |
| 2001/0025713 | A1 * | 10/2001 | Mcsheffrey | A62C 37/50 169/75 |
| 2008/0028083 | A1 * | 1/2008 | Rezvani | H04L 47/263 709/229 |
| 2012/0229283 | A1 * | 9/2012 | McKenna | G08B 25/10 340/584 |
| 2017/0169683 | A1 * | 6/2017 | Ryder | G08B 17/12 |
| 2017/0270366 | A1 * | 9/2017 | Kuznetsov | G01V 3/12 |
| 2018/0234266 | A1 * | 8/2018 | Rudolph | H04L 65/102 |
| 2018/0364654 | A1 * | 12/2018 | Locke | H04L 12/2827 |
| 2019/0066483 | A1 * | 2/2019 | Darling | H04W 52/0225 |
| 2019/0172165 | A1 * | 6/2019 | Verteletskyi | G06Q 50/163 |
| 2020/0106633 | A1 * | 4/2020 | Park | H04L 12/2823 |
| 2021/0128961 | A1 * | 5/2021 | Sauerbier | A62C 37/50 |

OTHER PUBLICATIONS

"A Study on the Fire IOT Development Strategy" by Zhang et al., dated 2013 (Year: 2013).*

* cited by examiner

Smart Fire Extinguisher

INTERNET FACILITATED FIRE SAFETY SYSTEM AND REAL TIME MONITORING SYSTEM

FIELD OF INVENTION

The present invention pertains to a smart fire safety system for all fire safety devices and equipment installed in a building and/or structure of which are connected via IOT (Internet Of Things) interface devices to enable data collection for these fire safety devices from a control room. More particularly, the invention pertains to system for remote monitoring and controlling via computer networks, such as intranet and/or Internet.

BACKGROUND OF THE INVENTION

Organizations which own, control or manage multiple sites such as businesses, property management groups, or government entities, are faced with a management and communication problem in that such remote and dispersed sites often include one or more continuously and independently operating fire alarm systems, security systems, building control systems or the like to monitor some or all of the regions of the respective properties. It is known to provide a communication link from fire monitoring systems to a local fire department for purposes of reporting one or more alarm conditions. However, such communication links do not necessary provide warnings or alarm indications to organizational management. Such links may not transfer information relative to the other types of systems.

Fire safety and management system for a building lags behind many business sectors in adoption of Internet of Things (IOT) technology. Currently, fire safety devices and equipment are manually checked for maintenance, which is time consuming and not pro-active. Maintenance is also labour intensive as technical staff would have to conduct checks of the fire safety equipment. Sometimes a piece of fire safety equipment may fail and only reported for repair or maintenance when the breakdown is observed or after a period of time. Some fire safety devices such as sprinkler systems are reactive, being turned on only in reaction to a fire. However if the sprinkler tank of the sprinkler system is low on water, such information would not be relayed to the control room or fire safety manager and if there is a fire, the sprinkler system would still be turned on, only to the dismay of all.

Another factor restricting the increased productivity in fire safety sector is the lack of integration of all devices and equipment in a centralised electronic system and which are capable of detecting and reporting changes not only in the safety devices and equipment, but also capable of detecting and reporting critical information on the surroundings of these safety devices and equipment and so that fire safety manager may decide on remedial action.

Under normal circumstances it would be difficult to organise, arrange and integrate a variety of safety devices and equipment since these devices and equipment are made by different manufacturers with different technical specifications. The installation of each type of device and equipment are carried out by different suppliers. Lastly the maintenance of each type of fire safety devices and equipment are carried out by the different suppliers who installed such devices and equipment.

It is desirable that all the critical disadvantages presently faced by a fire safety and management system in a building be overcome by a system which integrates the operations of all devices and equipment, monitor the statuses of these devices and equipment, monitor the surroundings and communicate sudden changes detected by each safety device or equipment to a control centre for immediate action.

It is also desirable for an improved internet facilitated fire safety system to continuously monitor the operational status of each device and equipment and pro-actively report any breakdown or failure of such device/equipment immediately so that each device and equipment are maintained at optimal operational condition all the time. Such a fire safety and management system should ideally be controlled by a SMART/IOT System to enable the whole system to be monitored and be controlled by safety manager or a control room effortlessly. It would be advantageous if the control room could respond pro-actively to any unusual incidents rather than react to such incidents, thereby losing time and reduce the possibility of greater damage or losses, both in terms of human lives and assets and in financial terms.

SUMMARY OF THE INVENTION

A main object of the present invention is to provide an internet facilitated fire safety system and a real time monitoring system, wherein the fire safety system comprises:— a configuration of smart fire safety devices and equipment, including fire extinguishers, hose reels, fire doors, exit lights, emergency lights, sprinkler tank and sprinkler system, system to monitor $CO_2$ and/or carbon monoxide levels, as well as other fire safety assets:— each of the smart fire safety devices and equipment is being connected by an IOT interface device and a wireless gateway to an electronic communications network and computer servers; and each IOT interface device is equipped with a plurality of sensors and software algorithms to communicate data on the status of each safety device, equipment and their conditions of their surroundings; wherein said data is transmitted through wireless gateway to computer servers in the internet facilitated fire safety system, the data undergo further processing and transforming synchronously using advanced algorithms and state-of the art analytics tools to generate critical fire safety information for critical decision making.

An object of the present invention is to provide an internet facilitated fire safety system and a real time monitoring system comprising:

(a) a plurality of fire safety devices including devices for putting off a fire; (b) a monitoring apparatus which includes devices to monitor $CO_2$, CO level at a specific surrounding;

(c) an IOT interface device with software, including a plurality of sensors to communicate with items (a) & (b) above with data generated by the components (a) & (b) of the specific surrounding; and (d) a wireless gateway being connected to electronic communications network and a computer server, thereby the data are transmitted through the wireless gateway to the computer server of the fire safety system, the data being processed and transformed synchronously to generate critical fire safety information for safety management.

Yet another object of the present invention is to provide an internet facilitated fire safety system, wherein each fire safety device and equipment is electronically connected to an electronic communications network, each transmitting data and information on its operational status or its surroundings, in real time and 24/7 for reporting, further analysis, decision making, fire safety compliance or immediate maintenance action by personnel in a control room of the fire safety and management system.

Still another object of the present invention is to provide an internet facilitated fire safety system and a real time monitoring system, wherein the IOT interface device having integrated software and sensors to obtain data from these existing fire safety hardware, transmits the data through the Internet to servers connected to a control room, where such data are monitored in real time to enable immediate corrective action, maintenance, decision making for fire safety management.

Another object of the present invention is to provide an internet facilitated fire safety system and a real time monitoring system, which allow users to access the information on fire safety hardware as maintained in the fire safety and management system from a variety of electronic devices, including personal computers, tablets and/or mobile phones.

Yet a further object of the present invention is to provide a method of monitoring a fire extinguisher of a safety fire system comprising the steps of:

(i) initializing a load cell equipped to the fire extinguisher and recording load cell data with temperature as a reference;

(ii) scheduling a collection of data;

(iii) comparing the collected data in step (ii) with the reference data of step (i) with a temperature compensation;

(iv) determining a leakage if the difference in step (iii) exceeds by 0.5%;

(v) alerting for a remedial action by sending a signal to the control room of the safety system.

A further object of the present invention is to provide an internet facilitated fire safety system and a real time monitoring system, wherein mobile apps are used and provide the users to access different operational aspects and/or access to receive and submit reports, photographs and videos relating to fire safety and management system.

Yet still an object of the present invention to provide an internet facilitated fire safety system and a real time monitoring system wherein a detection and feedback system is used in real time monitoring safety regulations compliance in a building.

BRIEF DESCRIPTION OF THE DRAWINGS

For a better understanding of the invention, its advantages, and the objects attained by its use, reference should now be made to the accompanying drawings. The accompanying drawings illustrate one or more embodiments of the invention and together with the description herein, serve to explain the workings and principles of the invention. The diagrams by no means restrict the invention to only what is shown.

DETAILED DESCRIPTION OF THE PRESENT INVENTION

The present invention relates to an internet facilitated fire safety system. The fire safety system comprises:

(a) a plurality of fire safety device including devices for putting off a fire;

(b) a monitoring apparatus which includes devices to monitor $CO_2$, CO level at a specific ambiance;

(c) an IOT interface device with software including a plurality of sensors to communicate with components (a) (b) & (c) above with data generated by the components (a), (b) and (c) of the specific ambiance; and (d) a wireless gateway being connected to an electronic communications network and a computer server, thereby the data are transmitted through the wireless gateway to the computer server of the fire safety system, said data being processed and transformed synchronously to generate critical fire safety safety information for safety management.

Figure 1:
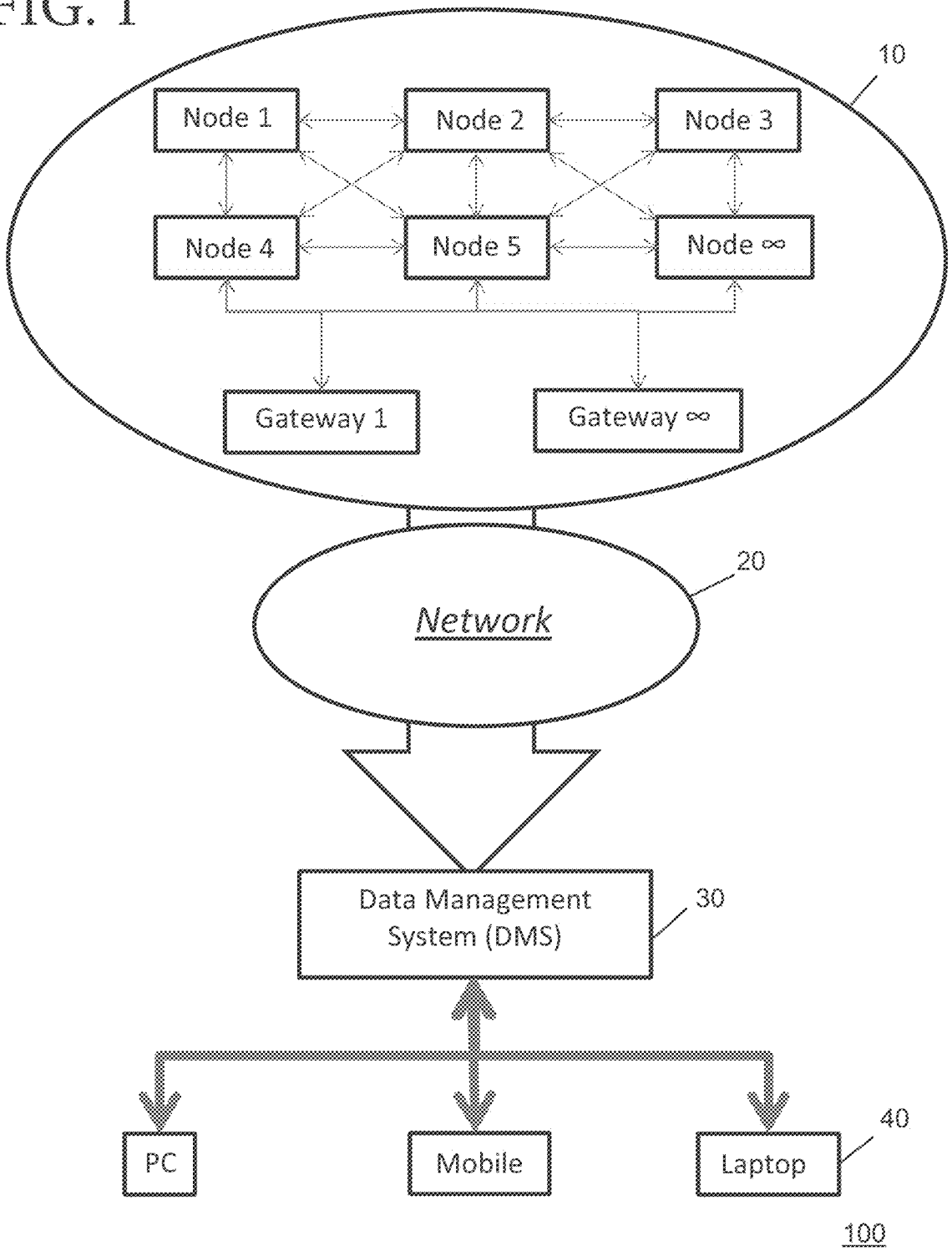
FIG. 1 shows a flowchart for the internet facilitated fire safety system and a real time monitoring system in accordance with the present invention.

In accordance with a preferred embodiments of the present invention, as shown in FIG. 1, the fire safety system and the real time monitoring system comprises (i) a plurality of node devices, which are functioned as real time monitoring devices; (ii) a communication network (20), (iii) a data management system (30); and (iv) a plurality of communication devices (40) including handphone, PC or laptop.

The fire safety system (100) makes use of existing fire safety hardware by connecting an IOT interface device with integrated software and sensors to obtain data from these existing fire safety hardware, transmit the data through the Internet to servers (20) connected to a control room. The data are monitored in real time to enable immediate corrective action, maintenance, decision making for fire safety management and legal compliance with fire safety requirements.

Since the existing fire safety devices and equipment do not transmit any form of data, the fire safety and management system uses an IOT interface device to connect each device and equipment to obtain data. To obtain the data for operational and maintenance purposes, the IOT interface device has appropriate sensors and software and algorithms to sense, process and compute raw data to derive real time information on operational status of each piece of fire safety asset and send operational information in real time to the servers for further analysis, reporting and decision making by personnel in the control room. In accordance with the present invention, the sensors include sensors to detect leakage (instantly able to know the status (operational) of a fire extinguisher) by using a precision load cell to detect the slight difference in weight of the loss of gas (leakage);

sensors to detect missing fire extinguisher (same as detection of leakages); sensors to detect blockage (accessibilities) using ultrasonic sensors set at a detection distance of 1 meter in front of the sensor, therefore sensing any item causing obstruction in the vicinity and reporting such incident to the control room immediately; sensors to capture surrounding temperature (through use of temperature sensors to feedback temperature readings of the surrounding and if an user is required to activate electrical appliances, inclusion of a relay to enable the activation; sensors to capture sound intensity (through use of a sound intensity sensor and setting a range to enable detection of the decibel of the alarm going off) and appropriate software and algorithms to report false alarms, alarm testing and real fire situations; sensors to monitor light intensity (energy saving); sensors to monitor humidity and temperature in the vicinity; sensors to detect leakage through use of flow switch sensors to detect the movement of water in the pipe; sensors to detect misuse of hose reel, through use of flow rate sensor to confirm the usage as hose reel are proper and not used for non-fire safety purposes; sensors to monitor backup batteries status by measuring the voltage to know the status of the backup batteries; sensors to monitor status of exit lights with light intensive sensors to detect the presence of light; ultrasonic sensors to detect and calculate water level in sprinkler tank; pressure sensor to confirm the working pressure range in the sprinkler system; $CO_2$ sensor to monitor $CO_2$ levels in the surroundings; carbon monoxide sensors to monitor CO levels in the surroundings. Besides the sensors mentioned above, other types of sensors may also be useful.

The IOT device works with wireless gateway to connect each piece of safety hardware to transmit data on the status of the safety hardware, processed and analysed by the software and algorithms, transmitted through the electronic network and through internet, to the computer servers and the cloud and received by the control room, which may be on-site or off-site.

FIG. 1 shows a flowchart of the internet facilitated fire safety system and a real time monitoring system in accordance with the present invention. The fire safety devices are mounted to by a plurality of nodes, and the nodes are connected to gateways. The fire safety and management system are electronically connected to a configuration of devices and equipment for optimal cost per fire safety asset utilisation. The configuration of devices and equipment includes fire extinguishers, hose reels, fire doors, exit lights, emergency lights, sprinkle tank, sprinkler system, and system to monitor $CO_2$ and/or carbon monoxide levels within the surrounding. The list of safety devices and equipment given above is by way of examples and therefore not exhaustive. The safety devices and equipment may also be collectively referred to herein as "safety hardware" or "safety assets".

Besides the IOT interface device with appropriate type of sensors for each piece of fire safety equipment, other types of devices would also be installed to enhance the operational efficiency of the devices and equipment and integrate these into an effective electronic communications network, including:—wireless gateways; motion detectors; smoke detectors; cameras to capture images periodically; and video cameras to capture and record activity continuously. The devices that to be connected to the fire safety and management system (100) as listed above are not exhaustive.

Each existing device and equipment is connected to the fire safety and management system by an IOT interface device which is plug-and-play ready. The use of an IOT interface device would enable interface by all fire safety devices and equipment made by any manufacturer immediately into the fire safety and management system. The use of an IOT interface device would save costs of replacing current safety devices and equipment with new in-built IOT-enabled devices and equipment. The use of an IOT interface device would also enable the fire safety and management system to be implemented easily and quickly since current safety devices and equipment would still be used by addition of an IOT Interface Device.

The fire safety and management system includes a control room which may be in the building or could be off-site, linked through the internet to the control room. Since the fire safety and management system is an electronic network, other users such as managers of separate business units in the same building or facility may receive reports on fire safety operations of their business as well as overall reports for the operational efficiency of the entire building or facility. Such reports may be real-time or collated for better reporting.

It is envisaged that a mobile app be used to allow users access to different operational aspects and/or receive and submit reports relating to fire safety and management. Users may therefore access the fire safety and management system to obtain reports from a variety of electronic devices, including personal computers, tablets and mobile phones.

Real time monitoring of all the devices and equipment within the fire safety and management system are electronically carried out and communicated by wireless gateway linked to IOT interface device connected to each safety device and equipment. It is also possibly that several safety devices and equipment may be linked to a wireless gateway in an area, for cost effective deployment of these devices. Machine data from each safety device and equipment is transferred wirelessly and securely to the wireless gateway due to the IOT Interface device. Due to the enormous quantity of data captured, and for operational efficiency, all the data arising from operation of the entire fire safety and management system are kept and linked by servers in off-site locations. Data stream ingestion, pre-processing, ETL and advanced analytics, big data storage/warehouse and API servers are combined into making the fire safety system using IOT technology workable and cost effective. Data gets processed and transformed synchronously using advance algorithms and state-of-the-art analytics tools to generate critical fire safety information for critical decision-making in an emergency. The same data may be further analysed into reports sent periodically or on an ad-hoc basis to users for follow up action or cost control reviews.

The function of each type of fire safety device and equipment is briefly explained in relation to the operational aspects of the fire safety and management system of this invention by reference to FIG. 2 to FIG. 9 which are simple illustrations of the workings of the fire safety and management system and some components of the system shown by their graphic symbols.

Figure 2:
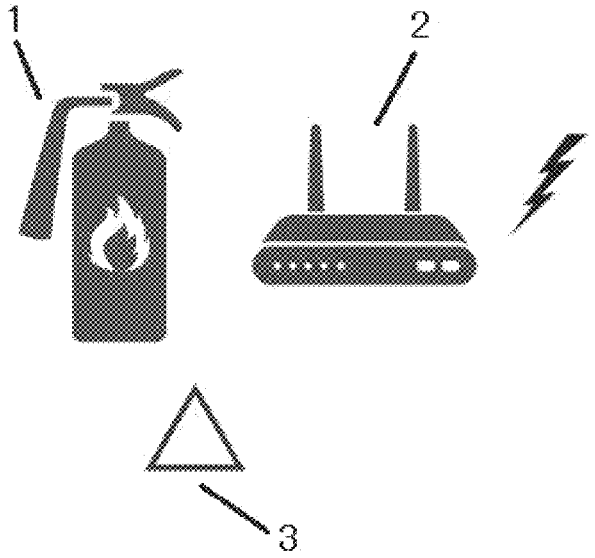
FIG. 2 shows a set up of a smart fire extinguisher of the internet facilitated fire safety system installed in a building or a facility in accordance with the present invention.
Figure 3:
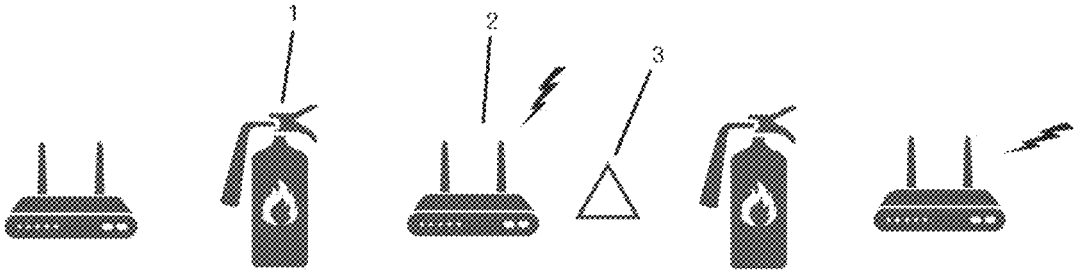
FIG. 3 shows a set up of a set of smart fire extinguishers of the internet facilitated fire safety system installed in a specific location within the building or a facility in accordance with the present invention.

FIG. 2 shows a set up of a smart fire extinguisher of the internet facilitated fire safety system installed in a building or a facility. FIG. 3 shows a set up of a cluster of smart fire extinguishers of the internet facilitated fire safety system installed in a specific location within the building or a facility.

The functions/features of the smart fire extinguisher (1) fitted with an IOT interface device (3) and wireless gateway (2) in the Fire safety and management system are as follows:— a. detect leakage (instantly able to know the status (operational) of each fire extinguisher (1) by using a precision load cell to detect the slight difference in weight of the loss of gas (leakage).

b. detect missing fire extinguisher (same as leakage), detect blockage (accessibilities) (using ultrasonic sensors set at a detection distance of 1 meter in front of the sensor, therefore sensing any item causing obstruction in the vicinity and reporting such incident to the control room immediately), c. capture surrounding temperature (through use of temperature sensors to feedback temperature readings of the surrounding and if an user is required to activate electrical appliances, a relay may be included to enable the activation. Therefore In a situation involving a fire on site, the control room will be able to obtain feedback on the hot zone area.

d. capture sound intensity (through use of a sound intensity sensor and setting it to a range to enable detection of the decibel of the alarm going off). The principle is that the alarm does not sound too long during alarm testing. Therefore the alarm system is considered to be working properly if all the sound sensors within the zone can detect the alarm sound during alarm bell maintenance, e. monitor light intensity (energy saving). This is an additional feature where the Fire safety and management system may detect the presence or absence of light in a location through a light intensity sensor. The monitoring of light intensity would enable the fire safety operators in the control room to switch off any unnecessary lights, thereby reducing energy consumption and saving costs.

f. monitor humidity and temperature in the vicinity thereby providing the control room and building managers better insight and information on energy usage within the facility.

Figure 4:
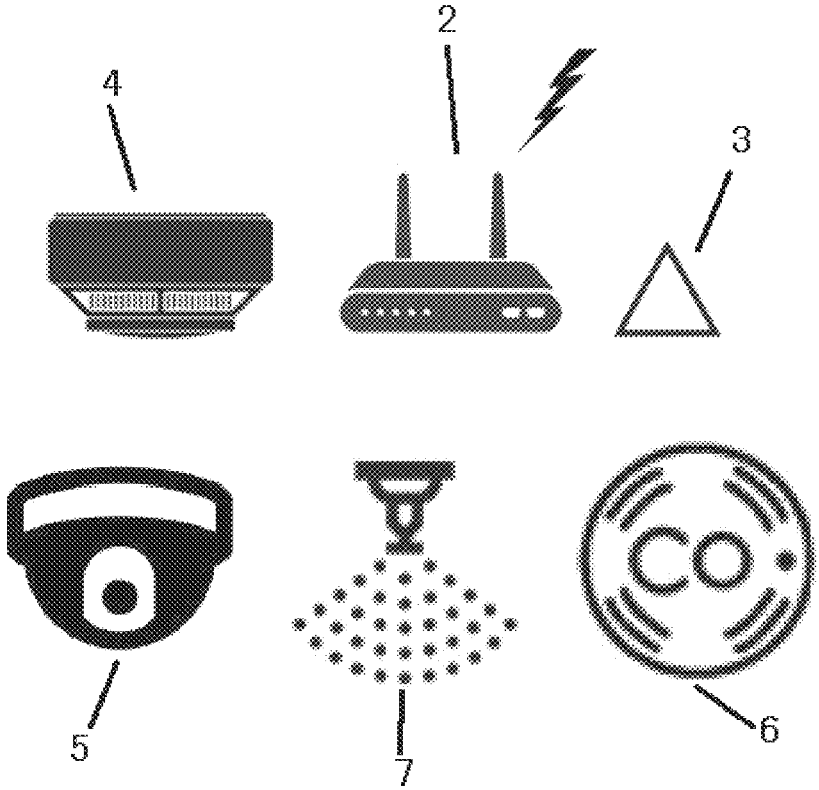
FIG. 4 shows a set up of smart $CO_2$ and/or carbon monoxide detection sub-system to monitor $CO_2$ and/or carbon monoxide levels of the internet facilitated fire safety system installed in a building or a facility in accordance with the present invention.

FIG. 4 shows a set up of smart $CO_2$ and/or carbon monoxide detection sub-system to monitor $CO_2$ and/or carbon monoxide levels of the internet facilitated fire safety system. The functions/features of smart monitoring system to monitor $CO_2$ and/or carbon monoxide uses existing $CO_2$ and/or carbon monoxide detectors (6) fitted with IOT interface devices (3) to monitor levels of $CO_2$ and/or carbon monoxide in locations such as carparks and kitchens. Other types of sensors such as smoke detectors (4), motion detectors (5) and sprinklers (7) are usually grouped together within the same vicinity for more effective monitoring of the said vicinity. These monitors work as follows:— a. The smart $CO_2$ and/or carbon monoxide detection sub-system would automatically detect abnormally high levels of $CO_2$ and/or carbon monoxide and would activate exhaust fans to remove $CO_2$ and/or carbon monoxide in the vicinity. This would be through use of $CO_2$ sensors to monitor $CO_2$ levels in the surroundings.

b. Carbon monoxide sensors are usually used inside underground carpark as such confined spaces tend to have high concentration of carbon monoxide. Hence the level of carbon monoxide must be monitored and immediate action taken to reduce any chance of an unfortunate incident from occurring.

c. The fire safety and management system would then issue an alert to the control room on high concentration of $CO_2$ and/or carbon monoxide. The system would then turn on the exhaust fans to remove $CO_2$ and/or carbon monoxide. The alert as well as the exhaust fans would continuously be working until the levels of $CO_2$ and/or carbon monoxide are within the set safe limits. Once this is achieved, the system would turn off the alert as well as the exhaust fans. The status of the fire safety and management system would then set the smart $CO_2$ and/or carbon monoxide detection sub-system back to "normal".

In some areas, smart smoke detectors and smart motion detectors would complement the data analysis transmitted by the IOT interface devices through the wireless gateway to enable the control room operators to further assess the situation in that vicinity and to make a decision to operate or override the activation of the sprinkler system (7).

Figure 5:
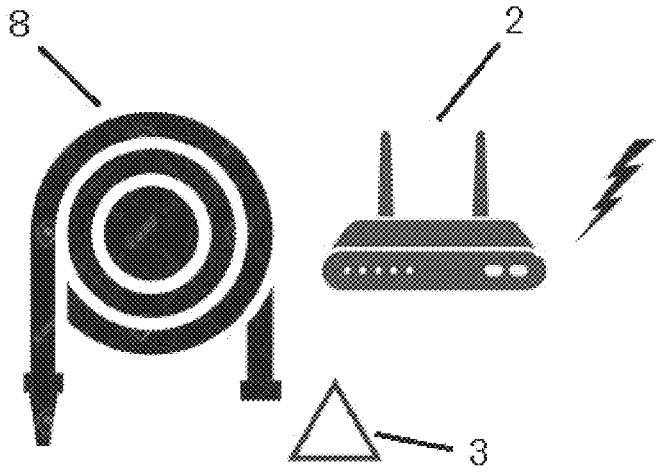
FIG. 5 shows a set up of a smart hose reel (8) of the internet facilitated fire safety system installed in a building or a facility in accordance with the present invention.
Figure 6:
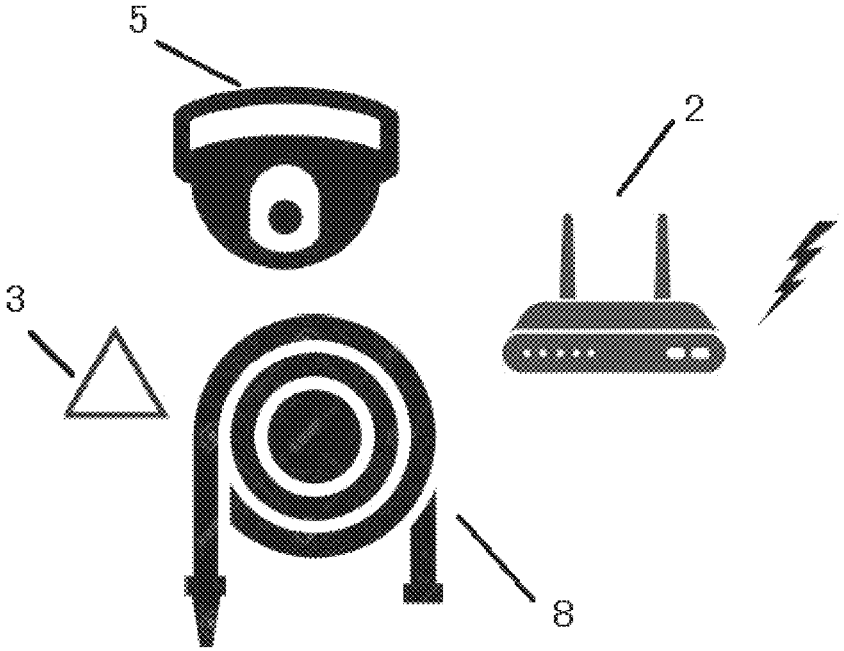
FIG. 6 shows another set up of the smart hose reel (8) with a motion detector (5) connected to the IOT interface device (3) and the wireless gateway (2) of the internet facilitated fire safety system installed in a building or a facility in accordance with the present invention.

FIG. 5 shows a set up of a smart hose reel (8) of the internet facilitated fire safety system installed in a building or a facility. FIG. 6 shows another set up of a smart hose reel (8) with motion detector (5) connected to the IOT interface device (3) and wireless gateway (2) of the internet facilitated fire safety system installed in a building or a facility. The functions/features of the hose reels fitted with an IOT interface device in the fire safety and management system are as follows:— a. detect leakage through use of flow switch sensors to detect the movement of water in the pipe.

b. detect misuse of hose reel, through use of flow rate sensor to confirm the usage as hose reel are proper and not used for non-fire safety purposes.

The functions/features of the sprinkler tank (not shown in any of the drawings) fitted with an IOT interface device in the fire safety and management system are as follows:— a. To detect its water level by using ultrasonic sensor to detect and calculate the level of the water.

Figure 7:
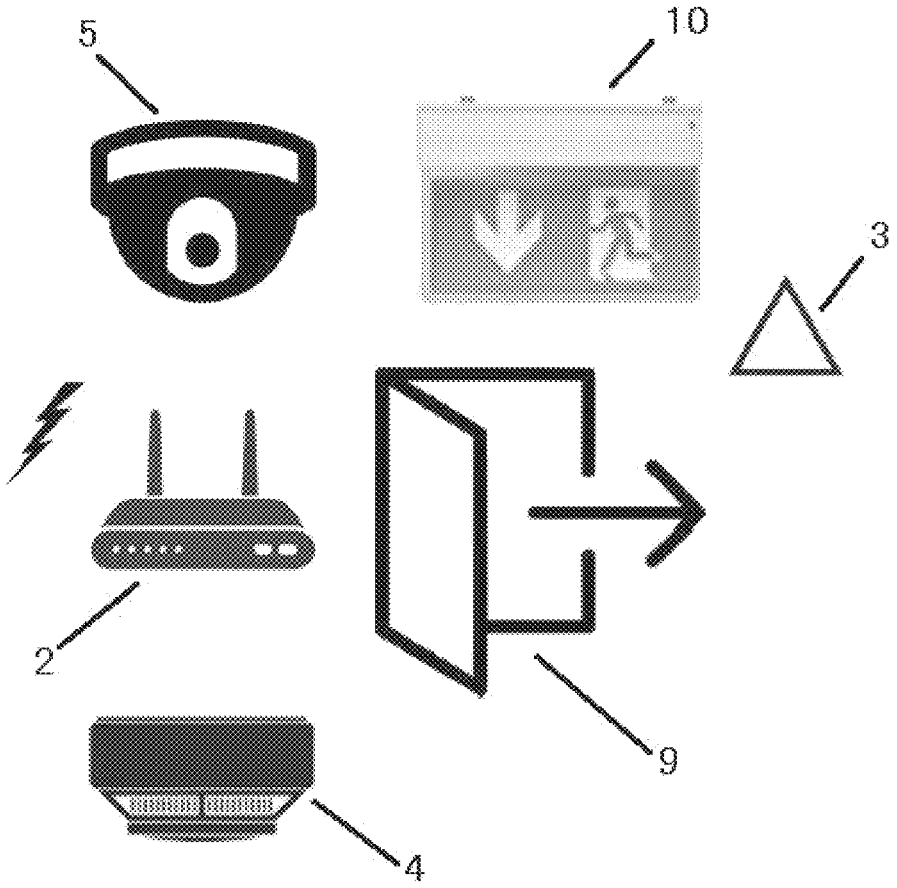
FIG. 7 shows a set up of the smart fire door, exit lights and emergency light sub-system of the internet facilitated fire safety system showing these different devices and equipment working in a vicinity in a building or a facility in accordance with the present invention.

FIG. 7 shows a set up of a smart fire door (9), smart exit lights (10) and smart emergency light sub-system of the internet facilitated fire safety system showing these different devices and equipment working together in a vicinity in a building or a facility.

The functions/features of the smart fire door (9) and its open/close status in the fire safety and management system are as follows:— a. On/off switch or ultrasonic switch to detect the position of the fire door

Referring to FIG. 7, the functions/features of the smart exit lights (10) in the fire safety and management system are as follows:— a. The exit lights must be always on as visibility under any condition and at all times is critical.

b. Monitoring backup batteries status by measuring the voltage to know the status of the backup batteries.

c. Monitoring of status of smart exit lights (10) with light intensive sensors to detect the presence of light. If no light is detected, the status would be immediately communicated to the control room which would result in checking of the exit light to confirm whether a light bulb is not working and to replace the light bulb if required. The fire safety and management system would then issue an alert to the control room for remedial action to be taken. The alert would continuously be set on until the defective light bulb is replaced. Once the defective light bulb has been replaced, the system would turn off the alert and set the status of the exit lights back to "normal".

Again referring to FIG. 7, the functions/features of the smart emergency light in the fire safety and management system are as follows:— a. backup batteries status, measure the voltage to know the status of the backup batteries.

b. Testing of light—use relay to activate the test switch and get feedback thru the light intensity sensor to confirm working status.

c. Motion detectors (5) in the event of absence of any light at all.

The fire safety and management system would then issue an alert to the control room for remedial action to be taken. The alert would continuously be set on until the emergency light is functioning properly. Once this is achieved, the system would turn off the alert and set the status of the smart emergency light back to "normal".

The functions/features of the smart sprinkler system (not shown) status monitoring module in the fire safety and management system are as follows:— a. Use pressure sensor to confirm the working pressure range

Figure 8:
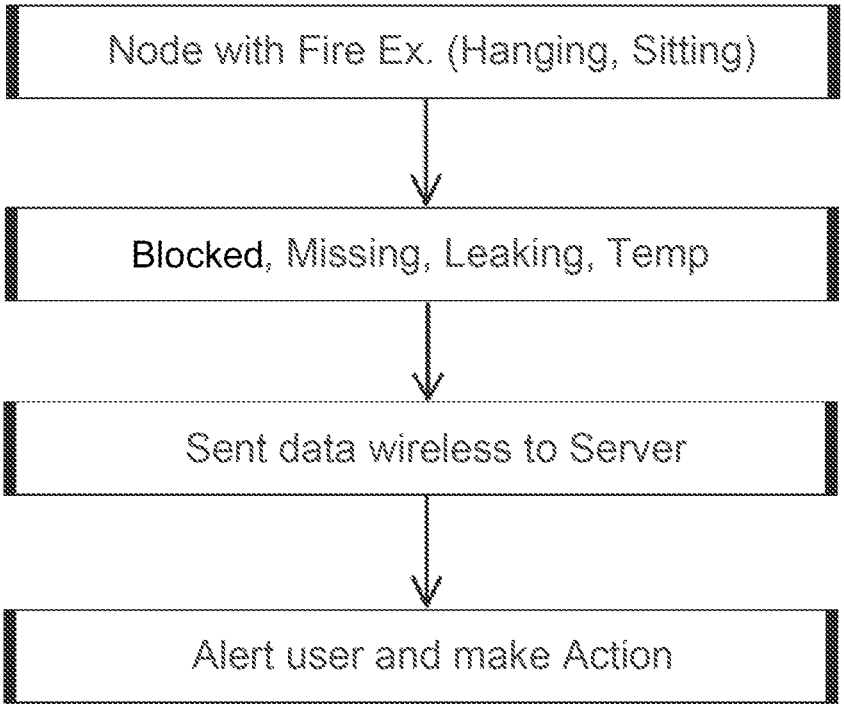
FIG. 8 shows a flowchart of the smart fire extinguisher with respect to working process in accordance with the present invention.
Figure 9:
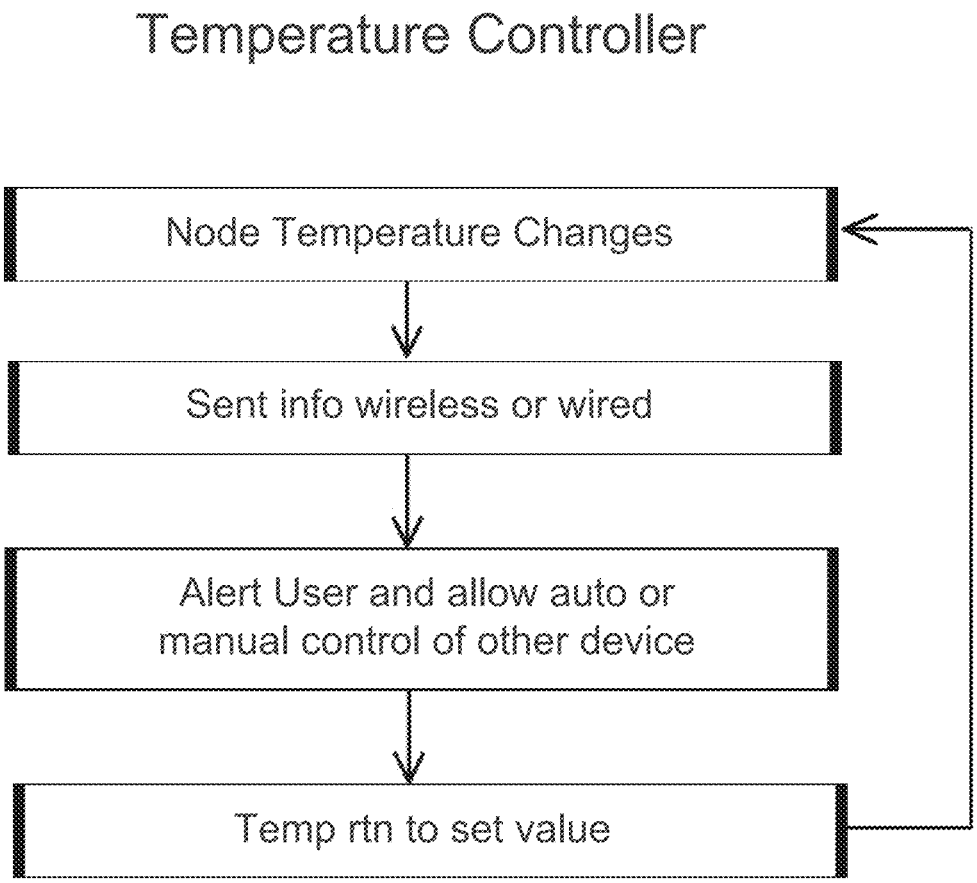
FIG. 9 shows a flowchart of the working of the temperature controller in the fire safety and management system in accordance with the present invention.

FIG. 8 and FIG. 9 show simple process flows for a component of the internet facilitated fire safety system. These are shown to illustrate the interactions between the sensors in the IOT interface device, the software and algorithms in the fire safety and management system and the IOT interface device connected to the physical hardware in each location in the building or facility.

FIG. 8 shows a process flow of a smart fire extinguisher of the inventive fire safety and management system in detecting a fire extinguisher which is missing or leaking. Through the use of software and algorithms, the sensors in the IOT interface device would transmit changes in physical parameters (such as weight loss) through the wireless gateway. If the weight loss is within a specified range, the fire safety and management system would report the smart fire extinguisher to be due for maintenance. If the weight is zero, the control room would send personnel to investigate whether the fire extinguisher is lost or misplaced.

FIG. 9 shows a process flow of a temperature controller in the fire safety and management system. The temperature controller installed in the IOT interface device may be connected at various nodes in the sprinkler system. If the temperature rises abruptly and within a specified range/time, through the use of software and algorithms, the sensors in the IOT interface device would transmit these changes in physical parameters (such as sudden temperature rise) through the wireless gateway. It is also usual for smoke detectors and other devices such as cameras or video cameras and motion detectors to provide other data to compliment the reporting of the sudden temperature change. With the combination of all data from various devices in the vicinity, the fire safety and management system would report the existence of a fire in the vicinity. The personnel in the control room and the fire safety and management system would go through programmed procedures to set off the sprinkler system and send an alert to the designated fire station. The fire safety and management system would activate other components of the fire safety and management system to obtain data from other parts of the building thus giving safety management a comprehensive real time assessment through alert messages, complimented by video feed, to enable safety management to manage the situation.

The fire safety and management system would also be used to monitor on a daily 24/7 basis compliance with safety regulations in a building through a detection and feedback system.

a. ensure proper use of fire extinguisher and fire safety products in selected locations and actively monitoring and reporting the operational status of all smart fire safety devices and equipment such as FX, HR, hydrant valve, escape sign, emergency light, fire doors, etc.

b. Check for blockage of fire and safety devices and equipment which may prevent their usage during an emergency.

c. Check for blockage of escape path for emergency use.

d. Ensure hazardous products are kept in designated safe areas.

e. Ensure all necessary fire safety products are in place and maintenance up to date.

f. Keep proper maintenance records of all fire safety products.

g. Actively send out status and/or warning alerts to the control room and operator onsite and/or offsite.

h. Improve productivity of fire safety services and maintenance work for the whole building.

i. Capture all information and activities in a centralised monitoring system and display all information and activities in the control room for improved productivity. All the data gets processed and are transformed synchronously using advance algorithms and state-of-the-art analytics tools to generate reports for users. Control room and fire safety Officers would receive critical fire safety information on a daily basis as well as a real-time basis. Other users may receive collated reports on a set-frequency for operational purposes.

j. Reduce manpower needed to individually and manually check each item of fire safety device and equipment for its operational status (including maintenance, function and location) reducing the need to inspect all areas of the building or facility.

The fire safety and management system would work with a mobile app (not shown) whereby maintenance workers may use the mobile app during all the maintenance works so as to help to activate certain function without the need of additional manpower. The mobile app would also allow maintenance workers to report any failure of safety devices and equipment to the control room immediately without the requirement to prepare and submit a maintenance report. The mobile app would also allow the maintenance worker to take photographs of the equipment and even videos of the equipment for improved record keeping and improved and clearer standard of reporting incidents.

The camera function in the mobile phone may also be used to capture alarm panel status and add on relay for isolation and simulation purpose.

The mobile app would reduce monthly and yearly maintenance work loads resulting in improved productivity and reduced manpower costs.

The internet facilitated fire safety system would also use drones to assist during smoke detectors maintenance works, thereby enhancing productivity.

The present invention is also related to a method of monitoring a fire extinguisher of a safety fire system comprising the steps of:

(i) initializing a load cell equipped to the fire extinguisher and recording load cell data with temperature as a reference;

(ii) scheduling a collection of data;

(iii) comparing the collected data in step (ii) with the reference data of step (i) with a temperature compensation;

(iv) determining a leakage if the difference in step (iii) exceeds by 0.5%;

(v) alerting for a remedial action by sending a signal to the control room of the safety system.

Advantageous Effects of the Invention

The present invention allows existing fire safety management to organise, arrange and integrate a variety of stand alone fire safety hardware devices and equipment into an effective network of smart fire safety devices and equipment, capable of providing feedback on operational statuses and conditions in surroundings and in real time.

The present invention also enhances the cost effectiveness of existing fire safety hardware devices and equipment which are made by different manufacturers with different technical specifications by integrating them into an effective fire safety system providing feedback 24/7 through the use of software and algorithms.

The maintenance of each type of fire safety devices and equipment are carried out by the different suppliers who installed such devices and equipment would also no longer be manually checked periodically, thereby reducing operational costs. Instead the fire safety and management system provides real time 24/7 reports on each type of fire safety hardware.

Compliance with fire safety requirements, including real time record keeping would be achieved through electronic record keeping and provision of reports on a periodic basis by the servers thus lowering operational costs.

Thus this present invention gives it a massive advantage over the existing independent fire safety assets which do not provide feedback to the control room and fire safety management.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An internet facilitated fire safety system comprising:

(a) a plurality of fire safety devices including at least one device for putting off a fire, wherein at least one of the fire safety devices function to detect leakage of a fire extinguisher, capture surrounding temperature, capture sound intensity, monitor light intensity, and monitor humidity and temperature in a vicinity;

(b) a monitoring apparatus which includes devices to monitor $CO_2$ and CO levels at a specific ambiance;

(c) an Internet of things (IOT) interface device including a temperature controller and a plurality of sensors, the IOT interface device implementing software to communicate with the plurality of fire safety devices, the devices of the monitoring apparatus, and the plurality of sensors, including receiving status data generated by the plurality of fire safety devices related to an operational status, ambiance data generated by the devices of the monitoring apparatus related to the specific ambiance, and sensing data generated by the plurality of sensors; and (d) a wireless gateway being connected to an electronic communications network and a computer server, whereby the status data, the ambiance data, and the sensing data are transmitted through the wireless gateway to the computer server of the fire safety system, being processed, and transformed synchronously to generate critical fire safety information for safety management;

wherein at least one of the plurality of sensors detects temperature changes and the temperature controller transmits physical parameters of the temperature changes through the wireless gateway and the IOT interface device automatically activates and controls other components of the plurality of fire safety devices, the devices of the monitoring apparatus, and the plurality of sensors to obtain additional status data, additional ambiance data, and additional sensing data to provide a comprehensive real time assessment using alert messages.

2. The internet facilitated fire safety system as set forth in claim 1, wherein the ambiance data of the specific ambiance are transmitted via the fire safety system to a control room for analysis and decision making by personnel.

3. The internet facilitated fire safety system as set forth in claim 1, wherein the IOT interface device is provided with integrated software and a plurality of sensors to obtain the status data, the ambiance data, and the sensing data from the fire safety device.

4. The internet facilitated fire safety system as set forth in claim 1, wherein the critical fire safety information of the fire safety system is accessed via personal computers, tablets, or mobile phones.

5. The internet facilitated fire safety system as set forth in claim 1, further comprising:

(e) a mobile app configured to access different operational aspects of the fire safety system, receive reports, and submit reports.

6. The internet facilitated fire safety system as set forth in claim 1, wherein the status data, the ambiance data, and the sensing data are transmitted in real time.

7. The internet facilitated fire safety system as set forth in claim 1, wherein the computer server includes software for determining an abnormal condition based on the status data, the ambiance data, and the sensing data.

8. The internet facilitated fire safety system as set forth in claim 1, further comprising (g) additional software to respond to a determined abnormality of a condition of a specific area based upon the ambiance data related to the specific ambiance.

9. The internet facilitated fire safety system as set forth in claim 1, wherein the critical fire safety information on fire safety hardware or software is accessible from a plurality of communication devices including mobile phones, personal computers, or tablets.

10. The internet facilitated fire safety system as set forth in claim 1, wherein the system provides a detection and feedback system in real time to monitor compliance with safety regulations of a building.

11. The internet facilitated fire safety system as set forth in claim 1, wherein the software is configured to access, receive, and submit reports, photographs, and videos relating to fire safety and management system.

12. The internet facilitated fire safety system as set forth in claim 1, wherein the plurality of fire safety devices includes devices from the group consisting of fire extinguishers, hose reels, fire doors, exit lights, emergency lights, sprinkler tank, and sprinkler systems to monitor carbon dioxide and carbon monoxide levels.

13. The internet facilitated fire safety system as set forth in claim 1, wherein all the fire safety devices are connected by the IOT interface device.

14. The internet facilitated fire safety system as set forth in claim 1, wherein the electronic communications network includes a wireless gateway, motion detectors, smokes detectors, cameras to capture images periodically, and a video camera to capture and to record activity continuously.

15. The internet facilitated fire safety system as set forth in claim 1, wherein all critical fire safety information and the status data, the ambiance data, and the sensing data are displayed in a control room.

16. The internet facilitated fire safety system as set forth in claim 1, wherein blockage of at least one of the plurality of the fire safety devices which may prevent the usage thereof is checked and reported.

17. The internet facilitated fire safety system as set forth in claim 1, wherein each of the plurality of sensors generate and transmit a parameter related to a condition based upon the ambiance data related to the specific ambiance.

18. The internet facilitated fire safety system as set forth in claim 1, wherein the electronic communications network allows receiving and processing the status data, the ambiance data, and the sensing data contained in a message.

19. The internet facilitated fire safety system as set forth in claim 1, wherein the software includes control software to establish an operator specified detector parameter to be forwarded via the electronic communications network.

20. The internet facilitated fire safety system as set forth in claim 1, further comprising a node device for real time monitoring and for collecting critical fire safety information in in real time to enable immediate detection and reporting of abnormal problems within the fire safety system.

21. The internet facilitated fire safety system as set forth in claim 20, wherein a relay activates electrical equipment connected to the node device.

22. The internet facilitated fire safety system as set forth in claim 21, wherein the node device is wireless.

23. The internet facilitated fire safety system as set forth in claim 20, wherein the fire safety device is configured to obtain the sensing data from the node device obtained from a plurality of integrated sensors.

24. The internet facilitated fire safety system as set forth in claim 20, wherein a plurality of gateways are connected to the node device.

25. The internet facilitated fire safety system as set forth in claim 1, further comprising a data management system, wherein critical fire safety information is delivered and stored via an internet connection of the electronic communications network to the data management system.

26. The internet facilitated fire safety system as set forth in claim 1, wherein the critical fire safety information is delivered, stored, and analyzed to activate fire safety equipment connected to a node device.

27. The internet facilitated fire safety system as set forth in claim 1, wherein for the sprinkler system within the fire safety system, real time monitoring of water level of the sprinkler tank, pump condition, pressure in the water pipe line are checked to allow detecting of abnormality of the sprinkler system.

28. The internet facilitated fire safety system as set claim 27, wherein the sprinkler system is equipped with a plurality of sensors.

29. The internet facilitated fire safety system as set forth in claim 28, wherein the sensors include pressure sensor, trigger sensor, temperature sensor, humidity sensor and pump sensors.

30. The internet facilitated fire safety system as set forth in claim 28, wherein a water level distance sensor is provided to monitor the water in the sprinkle water tank of the sprinkler system.

* * * * *